US006670744B2

(12) United States Patent
Chung

(10) Patent No.: US 6,670,744 B2
(45) Date of Patent: Dec. 30, 2003

(54) ELECTRON GUN FOR COLOR CATHODE RAY TUBE WITH MAIN LENS HAVING COMPOSITE ELECTRON BEAM PASSING APERTURES

(75) Inventor: Keun-tak Chung, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 340 days.

(21) Appl. No.: 09/756,265

(22) Filed: Jan. 9, 2001

(65) Prior Publication Data

US 2001/0045797 A1 Nov. 29, 2001

(30) Foreign Application Priority Data

May 25, 2000 (KR) ..... 2000-28332

(51) Int. Cl.[7] ..... H01J 5/00
(52) U.S. Cl. ..... 313/414
(58) Field of Search ..... 313/412, 413, 313/414, 444, 449; 315/15

(56) References Cited

U.S. PATENT DOCUMENTS 4,370,592 A 1/1983 Hughes et al. ..... 313/414
4,412,149 A 10/1983 Say ..... 313/414
4,599,534 A 7/1986 Shirai et al. ..... 313/414
4,626,738 A 12/1986 Gerlach ..... 313/414
4,728,858 A * 3/1988 Koshigoe et al. ..... 315/15
5,126,625 A * 6/1992 Cho ..... 313/414
5,414,323 A 5/1995 Uchida et al. ..... 313/414
5,481,560 A 1/1996 Potetz et al. ..... 375/238

* cited by examiner

*Primary Examiner*—Max Noori
(74) *Attorney, Agent, or Firm*—Leydig, Voit & Mayer, Ltd.

(57) ABSTRACT

An electron gun for a color cathode ray tube including an electron beam generating unit for generating three electron beams arranged in-line horizontally, an auxiliary lens forming unit for forming an auxiliary lens for focusing and accelerating the electron beams generated by the electron beam generating unit, and a main lens forming unit for forming a main lens, for finally focusing and accelerating the electron beams focused and accelerated by the auxiliary lens forming unit, and having first and second outer electrodes which face each other and in each of which a large electron beam aperture through which the three electron beams pass is located, and first and second inner electrodes respectively located inside the first and second outer electrodes and having three electron beam apertures with vertically elongated rectangular shapes.

11 Claims, 5 Drawing Sheets

ELECTRON GUN FOR COLOR CATHODE RAY TUBE WITH MAIN LENS HAVING COMPOSITE ELECTRON BEAM PASSING APERTURES

BACKGROUND OF THE INVENTION

1. Field of the Invention

The present invention relates to a color cathode ray tube (CRT), and more particularly, to an in-line electron gun having improved electrodes for forming a large electronic lens.

2. Description of the Related Art

In a general electron gun for a color cathode ray tube, spherical aberration and focusing characteristics are greatly dependent on a main lens. Thus, in order to obtain good focusing characteristics, the diameter of the main lens should be increased.

However, in an in-line electron gun, since three electron beam apertures are formed at at least two electrodes constituting an electronic lens it is impossible to make the diameter of an electron beam aperture larger than a distance between the centers of two adjacent electron beam apertures, which will be called an "eccentric distance" hereinafter.

An electron gun for improving spherical aberration in a conventional main lens is disclosed in U.S. Pat. No. 4,370,592, and is shown in FIG. 1.

As shown in FIG. 1, burring portions 1*b* and 2*b* are located at edges of an electron outlet surface 1*a* of a focusing electrode 1 and an electron inlet surface 1*a* of a final accelerating electrode 2, and large electron beam apertures 1H and 2H having a predetermined depth are located in the center. Also, small electron beam apertures 1H' and 2H' through which R, G and B electron beams pass independently, are located in the large electron beam apertures 1H and 2H.

When electron beams pass through a main lens formed by the focusing electrode 1 and the final accelerating electrode 2, since vertical and horizontal focusing field components acting on the electron beams passing through the central small electron beam aperture and the side small electron beam apertures are different due to horizontal elongation of the large electron beam apertures 1H and 2H, it is not possible to form symmetricral electron beam spots landing on a fluorescent surface. In other words, as shown in FIG. 2, side electron beams RB and BB having passed through the large electron beam apertures 1H and 2H of the focusing electrode 1 or the final accelerating electrode 2, are close to the burring portions 1*b* and 2*b* across which a low voltage or a high voltage is horizontally applied, and the central electron beam GB is relatively far from the burring portions 1*b* and 2*b*. Thus, the side electron beams RB and BB are relatively strongly focused and the central electron beam GB is weakly focused.

Also, since the distances between the side electron beams RB and BB and the burring portions 1*b* and 2*b* are different according to direction, the horizontal focusing power and vertical focusing power for the electron beams are different. Further, the vertical distances between the central electron beam GB and the burring portions 1*b* and 2*b* are shorter than the horizontal distances, so the electron beam is subjected to relatively strong vertical focusing power. Also, the central electron beam GB is subjected to divergent power in a diagonal direction of the large electron beam apertures 1H and 2H. Thus, the cross sections of the side electron beams RB and BB having passed through the main lens are substantially triangular and the cross section of the central electron beam GB is radially projected, thereby preventing the attainment of uniform cross sections of electron beams throughout the entire fluorescent plane.

In particular, the sizes of the small electron beam apertures 1H' and 2H' are limited by the diameter of a neck portion of a CRT. This sets a limit on increasing the eccentric distance between the small electron beam apertures 1H' and 2H'. Further, since the recent trend is toward reduction of the diameter of the neck portion in order to reduce deflection power, the distance between the small electron beam apertures 1H' and 2H' is reduced, thereby increasing spherical aberration and degrading focusing characteristics.

Technologies for solving the above-described problems are disclosed in U.S. Pat. Nos. 5,481,560, 4,599,534 and 4,412,149, in which independent small electron beam apertures are vertically elongated in inner electrodes installed inside an outer electrode for an electron beam, or side electron beam apertures are formed using the inner electrode and the inner circumferences of the outer electrode.

In the above-described electrode system for forming a main lens, electron beams passing through side electron beam apertures are vertically elongated to reduce a focus voltage difference due to the large diameter of the outer electrode. However, the electron beam landing on a phosphor layer is severely distorted due to the high current density of upper and lower parts of the vertically elongated electron beam.

Another arrangement of electrodes of an electron gun for solving the above-described problems is disclosed in U.S. Pat. No. 5,414,323. As shown in FIG. 3, this arrangement of electrodes of an electron gun includes an electrode plate member 12 in the center of an outer electrode 11 having a large electron beam apertures. A vertically elongated small electron beam aperture 13 is located in the center of the electrode plate member 16. Side edge portions of the electrode plate member 12 are recessed in a half-elliptical shape to form side electron beam apertures 14 and 15.

Since the central small electron beam aperture is vertically elongated, the astigmatism generated by the large electron beam aperture can be offset. However, according to this electrode arrangement, 8-pole coma aberration of the central electron beam aperture and 8-pole coma aberration of side electron beam apertures cannot easily be corrected.

Another arrangement of large electrodes is disclosed in U.S. Pat. No. 4,626,738. As shown in FIG. 4, this arrangement of electrodes includes an outer electrode 21 having a large electron beam aperture, and an inner electrode 22 installed inside the outer electrode 21 and having polygonal small electron beam apertures 22R, 22G and 22B. Here, although the aberration generated by the large electron beam aperture can be corrected by the polygonal small electron beam apertures 22R, 22G and 22B, it is not easy to fabricate the small electron beam apertures 22R, 22G and 22B.

SUMMARY OF THE INVENTION

To solve the above problems, it is an object of the present invention to provide an electrode system of an electron gun for a color cathode ray tube, which can easily correct aberration of an electronic lens formed by a large electron beam aperture, and can improve focusing characteristics.

It is another object of the present invention to provide an electron gun for a color cathode ray tube, which can reduce astigmatism by compensating for distortion of an electron beam due to a difference in the voltage applied across the space between each of three apertures disposed in an in-line arrangement.

To accomplish the first object of the present invention, there is provided an electron gun for a color cathode ray tube including means for generating three electron beams arranged in-line, means for forming an auxiliary lens for focusing and accelerating the electron beams generated by the electron beam generating means, and means for forming a main lens, for finally focusing and accelerating the electron beams focused and accelerated by the auxiliary lens forming means, and having first and second outer electrodes which face each other and in each of which a large electron beam aperture through which the three electron beams pass is formed, and first and second inner electrodes each installed inside the first and second outer electrodes and having three electron beam apertures shaped of vertically elongated squares.

In the present invention, recessed portions having different depths are formed at facing vertical peripheries of side electron beam apertures among the three electron beams of the first inner electrode, the recessed portions formed at the outer vertical peripheries being deeper than those formed at the vertical peripheries positioned near the central electron beam aperture. Also, recessed portions having the same depth are formed at facing vertical peripheries of side electron beam apertures among three electron beam apertures of the second inner electrode.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
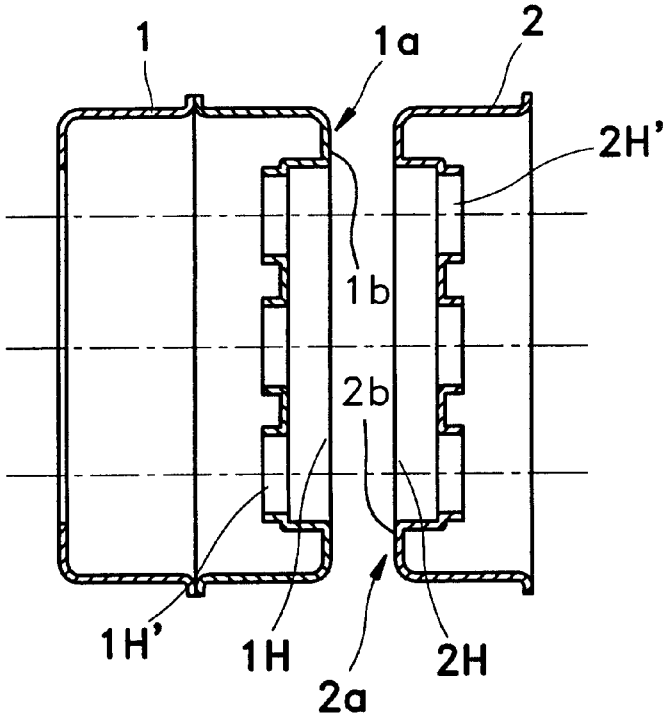
FIG.1 (PRIOR ART)
FIG. 1 is a cross-sectional view illustrating a conventional electrode system of an electron gun for a color cathode ray tube.
Figure 2:
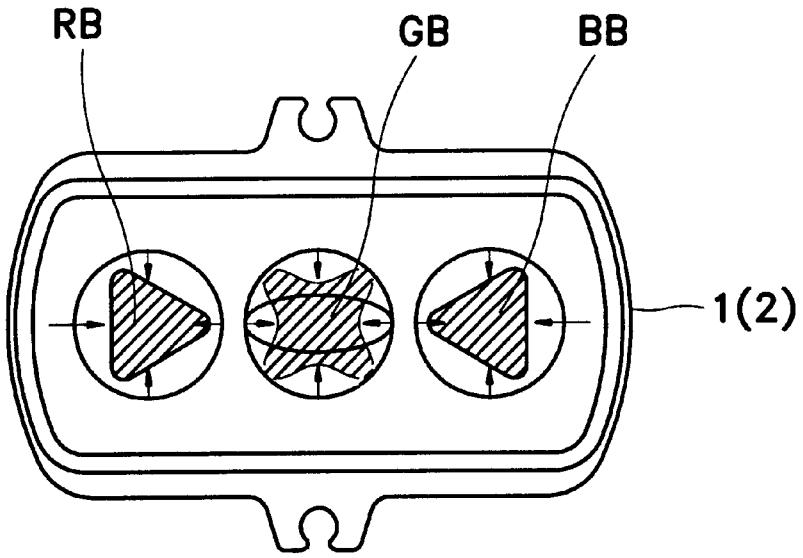
FIG. 2 (PRIOR ART)
FIG. 2 is a front view of a conventional electrode system of an electron gun, illustrating cross sections of electron beams.
Figure 3:
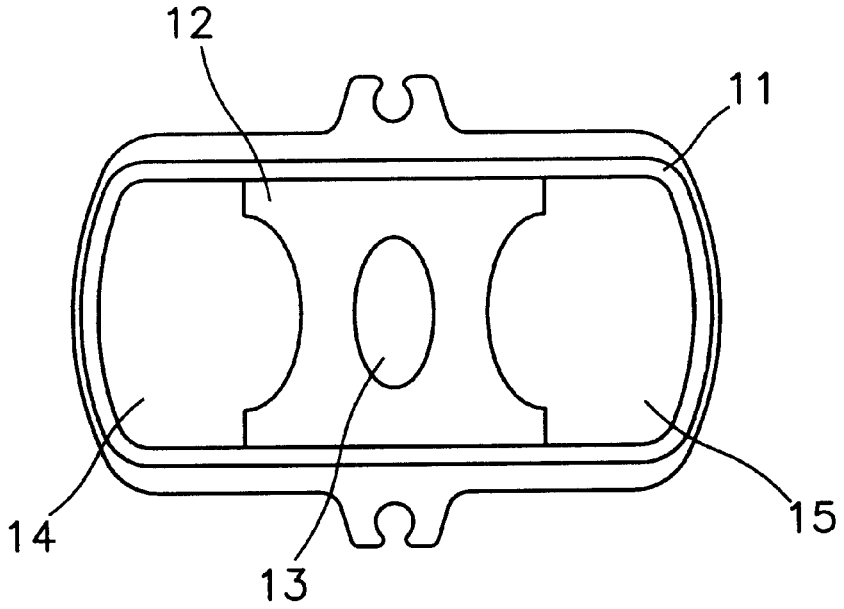
FIG. 3 (PRIOR ART)
FIGS. 3 and 4 are front views of other examples of a conventional electrode system of an electron gun.
Figure 4:
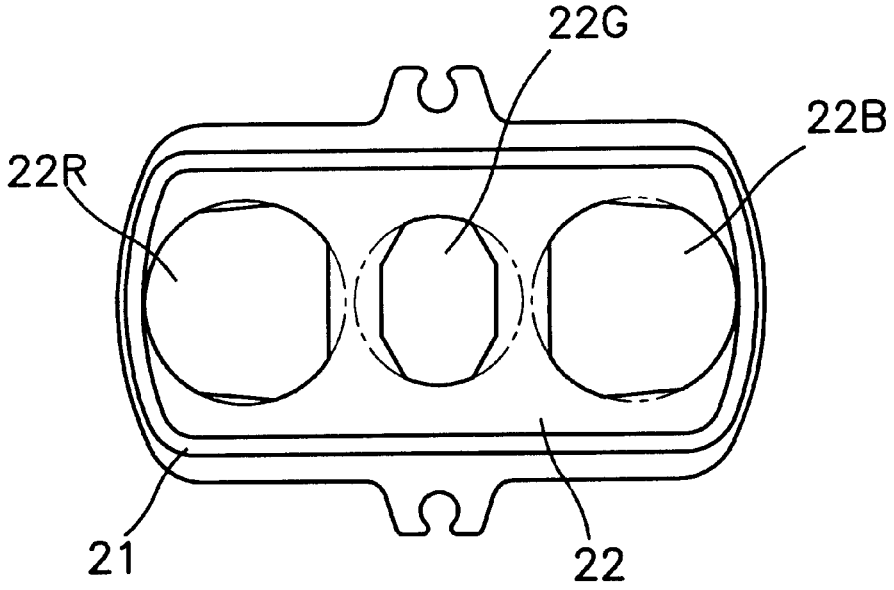
FIG. 4 (PRIOR ART)
Figure 5:
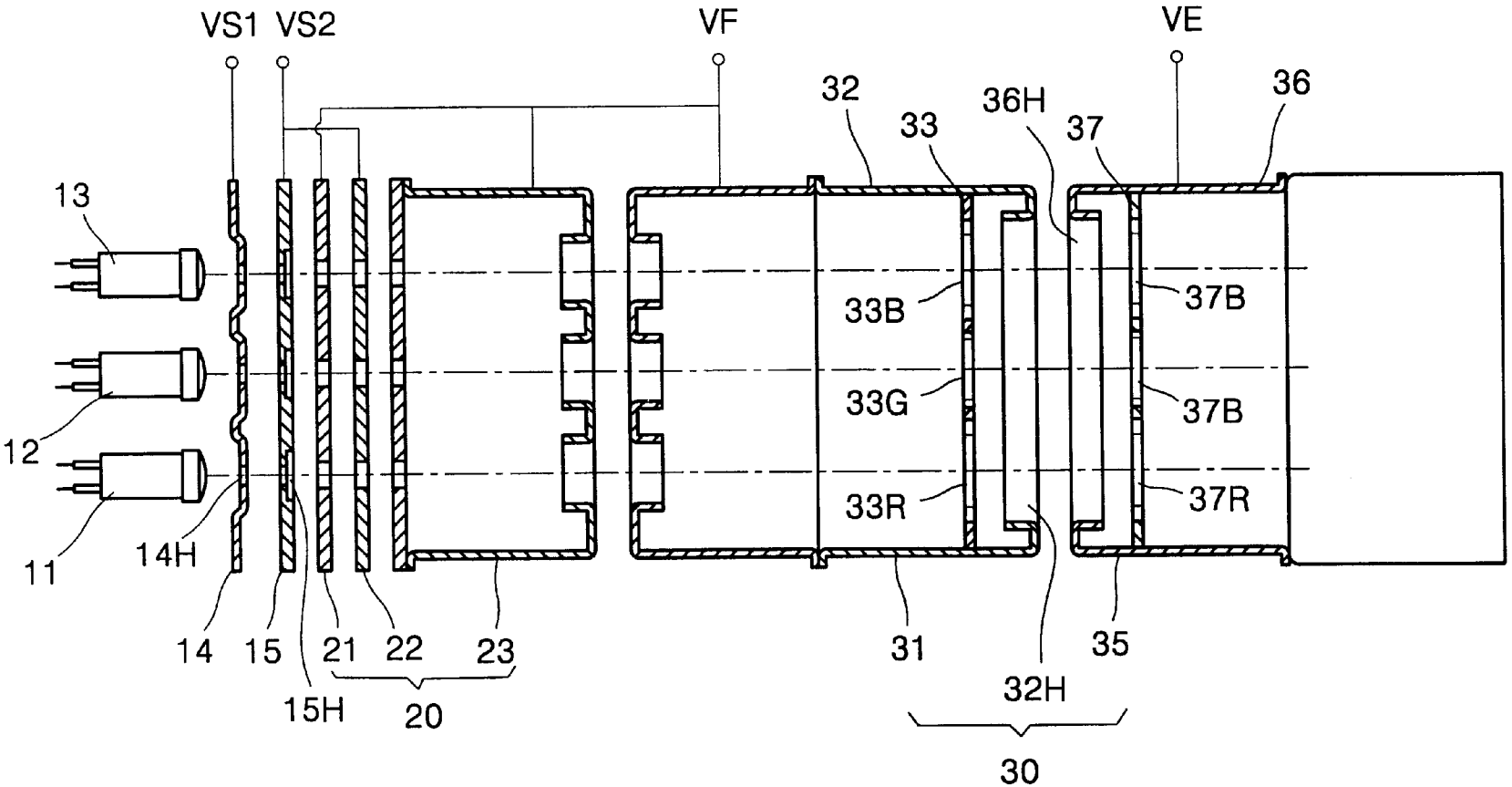
FIG. 5 is a cross-sectional view of an electron gun for a color cathode ray tube according to the present invention, in which application of voltages is shown.

FIG. 5 shows an electron gun for a color cathode ray tube (CRT) employing an electrode system according to an embodiment of the present invention.

As shown, the electron gun for a color CRT includes a triode having three cathodes 11, 12 and 13 in an in-line arrangement, for emitting electron beams for exciting a phosphor layer, a control electrode 14 having electron beam apertures at positions facing the respective cathodes 11, 12 and 13 and a screen electrode 15, first, second and third focusing electrodes 21, 22 and 23 sequentially installed from the screen electrode 15 and having electron beam apertures to form auxiliary lens forming unit 20 for focusing and accelerating electron beams, and first and second main electrodes 31 and 35 sequentially installed from the third focusing electrode 23 of the auxiliary lens forming unit 20 to form a main lens forming unit 30. Here, electron beam apertures 14H in the control electrode 14 are circular or vertical elongated, electron beam apertures 15H in the screen electrode 15 are stepped such that they have a smaller diameter at the cathode side and a large diameter at the first focusing electrode side. Also, the electron beam apertures 21H, 22H and 23H in the inlet surface of the first, second and third focusing electrodes 21, 22 and 23 may be circular or vertical elongated.

The first and second main electrodes 31 and 35 forming the main lens forming unit 30 include first and second outer electrodes 32 and 36 having large electron beam apertures 32H and 37H, through which three electron beams pass, on facing surfaces, and first and second inner electrodes 33 and 37 installed inside the first and second outer electrodes 32 and 36 and having separate small electron beam apertures 33R/33G/33B and 37R/37G/37B, respectively.

Figure 6:
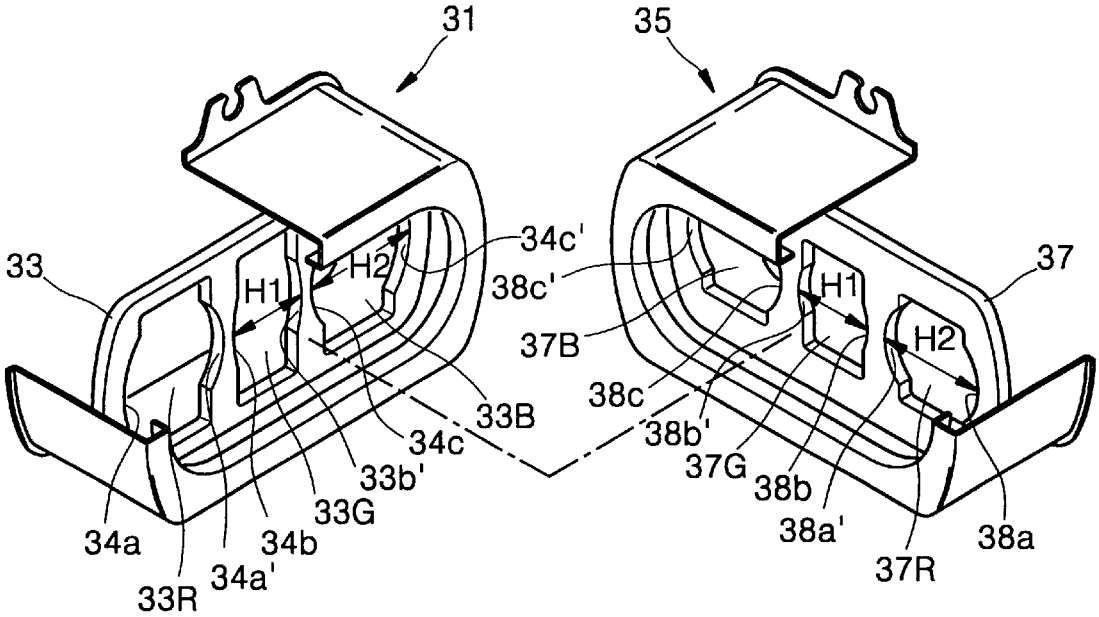
FIG. 6 is an exploded perspective view of electrodes which constitute a main lens unit according to the present invention.

The three separate small electron beam apertures 33R, 33G and 33B in the first inner electrode 33, as shown in FIG. 6, are vertical elongated rectangles, and include widened portions 34*a*/34*a*', 34*b*/34*b*' and 34*c*/34*c*' are located in central portions of facing vertical peripheries. The widened portions 34*a* and 34*c*' positioned at the vertical peripheries of the outer sides of the side electron beam apertures 33R and 33B, that is, far from the central electron beam aperture 33G, are larger than the widened portions 34*a*' and 34*c* positioned at the vertical peripheries facing the recessed portions 34*a* and 34*c*', that is, at the central electron beam aperture sides.

The three separate small electron beam apertures 37R, 37G and 37B in the second inner electrode 37 positioned inside the second outer electrode 35 are vertically elongated rectangles. Widened portions 38*a*/38*a*', 38*b*/38*b*' and 38*c*/38*c*' are located in the central portions of the facing vertical peripheries. Here, the horizontal widths H1 of the central small electron beam apertures 33G and 37G of the first and second inner electrodes 33 and 37 are narrower than the horizontal widths of the side small electron beam apertures 33R/33B and 37R/37B.

As described above, predetermined voltages are applied to the respective electrodes constituting an electron gun. In one embodiment of the present invention, a voltage VS1 of 0 to 200 V may be applied to the control electrode 14 and a voltage VS2 of 200 to 700 V may be applied to the screen electrode 15 and the second focusing electrode 22.

Also, a voltage VF is applied to the first and third focusing electrodes 21 and 23 and the first main electrode 31, the voltage VF being 28 to 30% of the voltage applied to the second main electrode 35 to which the same voltage as that applied to the internal conductive layer of the CRT is applied.

Here, the voltage applied to the first and third focusing electrodes 21 and 23 and the first main electrode 31 may be a dynamic focus voltage synchronized with a deflection signal. A voltage VE of 25 to 30 KV is applied to the second main electrode 35.

The operation of the above-described electron gun for a color CRT according to the present invention will now be described.

A predetermined voltage is applied to the cathodes 11, 12 and 13 and various electrodes constituting the electron gun in the above-described manner. If the voltage is applied, a pre-focus lens is formed between the control electrode 14 and the screen electrode 15, and a unipotential auxiliary lens and a bipotential auxiliary lens are formed between the first, second and third focusing electrodes 21, 22 and 23 and the main lens 31. A main lens is formed between the first and second main electrodes 31 and 35.

The main lens formed between the first and second main electrodes 31 and 35 is formed by equipotential lines normal to the electric field formed between the first and second focusing electrodes 31 and 35.

Here, as described above, since the large electron beam aperture 32H (36H) is horizontally elongated, there is a difference in the focus voltage acting on the central electron beam aperture and the side electron beam apertures. Thus, vertically convergent components and horizontally convergent components of electron beams having passed through the central small electron beam aperture 33G (37G) and the side small electron beam apertures 33R and 33B (37R and 37B), are different, respectively, so that the electron beams are subjected to different convergent and divergent forces. In other words, since the horizontal and diagonal distances across the large electron beam aperture 32H (36H), in which a low voltage and a high voltage are distributed, are relatively long, large divergent forces are applied to the electron beams horizontally and diagonally. This action causes a difference in the focusing voltage among three electron beams, thereby lowering focusing characteristics of three electron beams.

In the aforementioned electron gun, the side separate small electron beam apertures 33R/33B and 37R/37B of the first and second focusing electrodes 31 and 35 forming a main lens and the central electron beam apertures 33G and 37G are vertically elongated and have widened portions having different widths at facing vertical peripheries, thereby compensating for distortion of the cross section of an electron beam and enlarging the electron beam aperture.

In more detail, in the central electron beam apertures 33G and 37G among the separate small electron beam apertures 33R/33G/33B and 37R/37G/37B of the first and second main electrodes 31 and 35 forming the main lens, and the central electron beam passing through an electronic lens formed by the large electron beam aperture 32H (36H), the horizontal diverging power is larger than the horizontal converging power and vertical diverging power is larger than the vertical converging power.

Also, the side electron beam apertures 33R/33B and 37R/37B and the central electron beam passing through an electronic lens formed by the large electron beam aperture 32H (36H) are subjected to larger horizontal convergent power than the horizontally divergent power and larger vertical divergent power than the vertically convergent power. This divergent power is smaller than the divergent power acting on the central electron beam passing through the central electron beam apertures 33G and 37G and the electron lens formed by the large lens.

Therefore, it is possible to prevent distortion of the cross section of the electron beam due to a difference in the focus voltage between the central and peripheral portions of the electronic lens formed by the large electron beam aperture.

Figure 7:
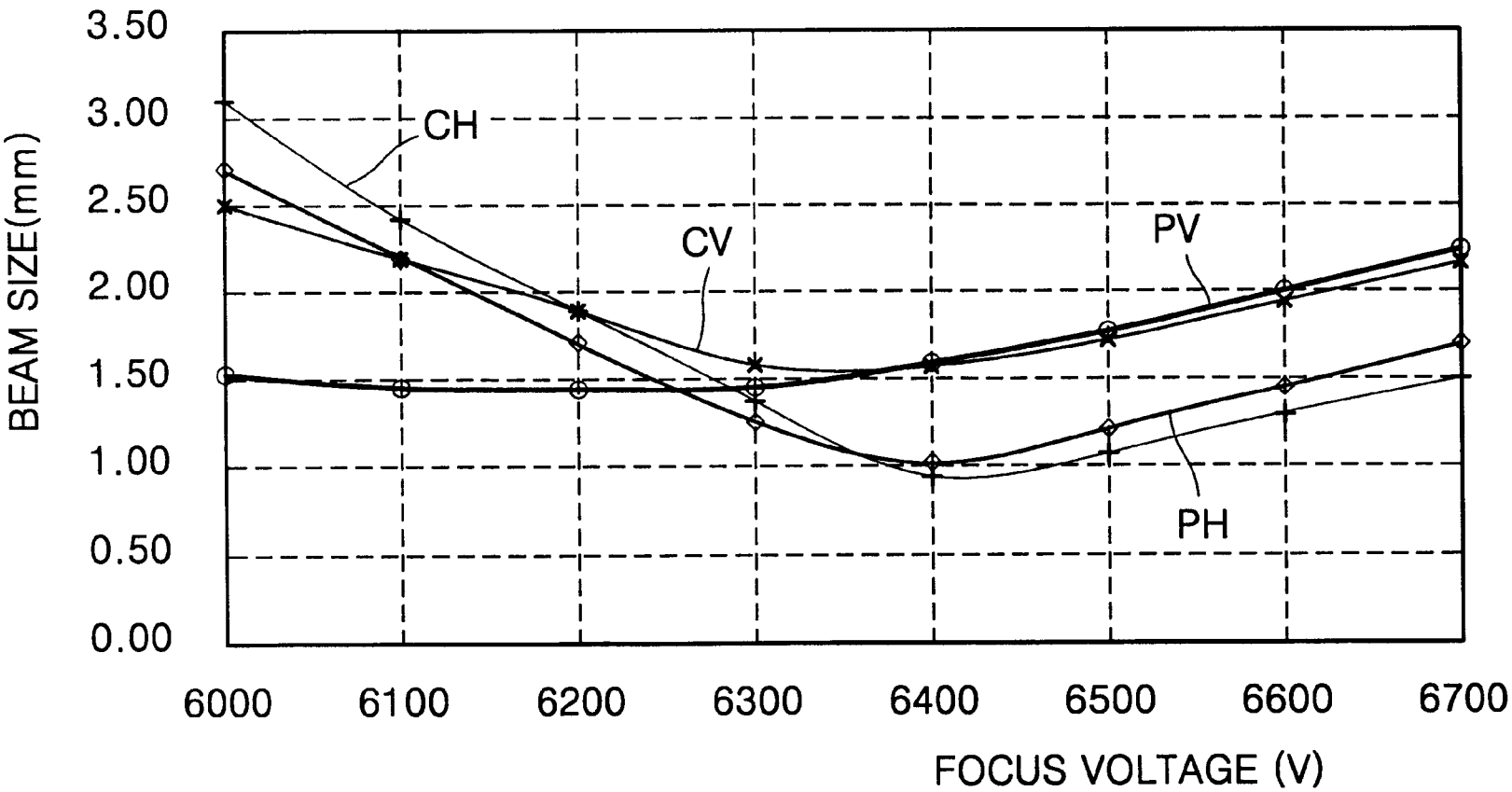
FIG. 7 is a graph showing the relationship between a focus voltage and electron beam size in an electron gun according to the present invention and a conventional electron gun.

FIG. 7 shows the relationship between focus voltage and electron beam size, in an electron gun according to the present invention, and a conventional electron gun having separate small electron beam apertures in electrodes forming a main lens which are simply vertical elongated.

Referring to FIG. 7, in the electron gun according to the present invention, the horizontal and vertical sizes of electron beams landing on a phosphor layer are not considerably varied according to the change in the focus voltage (see plots PH and PV). However, in the conventional electron gun, when the focus voltages are 6,000 V and 6,400 V, the change in the horizontal and vertical beam sizes is large (see plots CH and CV).

In the electron gun according to the present invention, among the widened portions 34*a*/34*a*', 34*c*/34*c*', 38*a*/38*a*' and 38*c*/38*c*' at the peripheries of sides of the separate small electron beam apertures 33R/33B and 37R/37B, the outer widened portions 34*a*/34*c* and 38*a*/38*c* are wider than the central aperture side widened portions 34*a*'/34*c*' and 38*a*'/38*c*'. Thus, the electronic lens formed by the side separate small electron beam apertures 33R/33B and 37R/37B are asymmetrical formed, thereby making the side electron beams among three electron beams disposed in an in-line arrangement converge toward the central electron beam.

In the electrodes of an electron gun for a color CRT according to the present invention, aberration of an electron beam caused by large electron beam apertures can be reduced, and the cross section of an electron beam can be changed into a desirable shape. In particular, focusing characteristics of electron beams can be improved by reducing a difference in the focusing forces on electron beams passing through a large electron beam aperture.

While the present invention has been described in conjunction with the preferred embodiments disclosed, it will be apparent to those skilled in the art that various modifications and variations can be made within the spirit or scope of the invention defined in the appended claims.

What is claimed is:

1. An electron gun for a color cathode ray tube comprising:

means for generating three electron beams in a common plane;

means for forming an auxiliary lens for focusing and accelerating the electron beams generated by the electron beam generating means; and means for forming a main lens, for focusing and accelerating the electron beams focused and accelerated by the auxiliary lens, and including first and second outer electrodes which face each other and which each include a large electron beam aperture through which all of the three electron beams pass, and first and second inner electrodes respectively located inside the first and second outer electrodes, each of the first and second inner electrodes having first, second, and third small electron beam apertures aligned side-by-side along an axis generally parallel to the common planes, wherein each of the small electron beam apertures has a composite shape defined by respective edges of the small electron beam apertures, and the edges define a generally rectangular shape with a pair of straight shorter sides generally parallel to the common plane and a pair of longer sides having straight portions, generally perrendicular to the common plane, and centrally located convex arcuate portions, so that each of the small electron beam apertures is widest in a central portion along the axis.

2. The electron gun according to claim 1, wherein the arcuate portions of the pairs of longer sides of each of the first and third electron beam passing apertures are asymmetrical, the first and second electron beam apertures being located on opposite sides of the second electron beam aperture.

3. The electron gun according to claim 2, wherein the arcuate portions of the longer sides of the first and third electron beam apertures, most remote from the second electron beam aperture extend further from the adjacent straight portions of the respective longer sides of the first and third electron beam apertures than the arcuate portions of the longer sides of the first and third electron beam apertures closest to the second electron beam aperture extend from the adjacent straight portions of the respective longer sides of the first and third electron apertures.

4. The electron gun according to claim 1, wherein the first and third electron beam apertures are on opposite sides of the second electron beam aperture and the first and third electron beam apertures have identical dimensions along the axis in the first and second inner electrodes, respectively.

5. The electron gun according to claim 1, wherein the means for forming an auxiliary lens includes first, second, and third focusing electrodes and an inlet surface of the first outer electrodes.

6. The electron gun according to claim 5, wherein the means for generating three electron beams includes, serially arranged, three cathodes, a control electrode, and a screen electrode, a first voltage is applied to the screen electrode and the second focusing electrode, a voltage higher than the first voltage applied to the screen electrode and the second focusing electrode is applied to the second outer electrode, and a voltage corresponding to 28 to 30% of the voltage applied to the second focusing electrode is applied to the first and third focusing electrodes and the first outer electrode.

7. The electron gun according to claim 4, wherein the second electron beam apertures of the first and second inner electrodes have identical dimensions along the axis.

8. The electron gun according to claim 7, wherein the dimensions of the first and third electron beam apertures of the first and second inner electrodes along the axis are longer than the dimensions of the second electron beam apertures of the first and second inner electrodes along the axis.

9. The electron gun according to claim 3, wherein the first and third electron beam apertures have identical dimensions along the axis in the first and second inner electrodes, respectively.

10. The electron gun according to claim 9, wherein the second electron beam apertures of the first and second inner electrodes have identical dimensions along the axis.

11. The electron gun according to claim 10, wherein the dimensions of the first and third electron beam apertures of the first and second inner electrodes along the axis are longer than the dimensions of the second electron beam apertures of the first and second inner electrodes along the axis.

* * * * *